US010284937B2

(12) United States Patent
Nakatsukasa

(10) Patent No.: US 10,284,937 B2
(45) Date of Patent: May 7, 2019

(54) SOUND OUTPUT AND PICKUP DEVICE

(71) Applicant: YAMAHA CORPORATION, Hamamatsu-shi (JP)

(72) Inventor: Hitoshi Nakatsukasa, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/635,368

(22) Filed: Jun. 28, 2017

(65) Prior Publication Data

US 2017/0303025 A1 Oct. 19, 2017

Related U.S. Application Data

(63) Continuation of application No. PCT/JP2016/074340, filed on Aug. 22, 2016.

(30) Foreign Application Priority Data

Aug. 24, 2015 (JP) ..... 2015-164817

(51) Int. Cl.

| | |
|---|---|
| ***H04R 1/02*** | (2006.01) |
| ***H04R 1/04*** | (2006.01) |
| ***H04R 1/32*** | (2006.01) |
| ***H04R 3/00*** | (2006.01) |
| ***H04R 1/06*** | (2006.01) |

(52) U.S. Cl.

CPC ..... *H04R 1/025* (2013.01); *H04R 1/04* (2013.01); *H04R 1/326* (2013.01); *H04R 3/00* (2013.01); *H04R 1/06* (2013.01)

(58) Field of Classification Search

CPC ..... H04R 1/025; H04R 1/326; H04R 3/00

See application file for complete search history.

(56) References Cited

U.S. PATENT DOCUMENTS

| | | | | |
|---|---|---|---|---|
| 5,778,085 | A | 7/1998 | Sasaki | |
| 5,909,498 | A * | 6/1999 | Smith | H04R 1/1016 381/375 |
| 2006/0067555 | A1 * | 3/2006 | Tsai | H04R 1/1016 381/380 |
| 2007/0064925 | A1 | 3/2007 | Suzuki et al. | |

(Continued)

FOREIGN PATENT DOCUMENTS

| | | | |
|---|---|---|---|
| JP | S5850782 | U | 4/1983 |
| JP | 2739835 | B2 | 4/1998 |
| JP | 2015012436 | A * | 1/2015 |

OTHER PUBLICATIONS

International Search Report issued in Intl. Appln. No. PCT/JP2016/074340 dated Sep. 20, 2016. English translation provided.

(Continued)

*Primary Examiner* — Sonia L Gay

(74) *Attorney, Agent, or Firm* — Rossi, Kimms & McDowell LLP

(57) ABSTRACT

A sound output and pickup device is provided with a speaker system, a microphone, and a housing. The housing includes inside the speaker system, the microphone, and a wall that divides a space in which the speaker system is stored and a space in which the microphone is stored. The wall has a through hole. The distance from the through hole to the outside of the housing is shorter than the distance from the through hole to the microphone.

20 Claims, 5 Drawing Sheets

(56) References Cited

U.S. PATENT DOCUMENTS

| | | | | |
|---|---|---|---|---|
| 2011/0058695 | A1* | 3/2011 | Yoshino | H04R 1/083 381/174 |
| 2012/0281854 | A1 | 11/2012 | Ishibashi et al. | |
| 2014/0037081 | A1 | 2/2014 | Ishibashi et al. | |
| 2014/0226832 | A1* | 8/2014 | Shimizu | H04R 1/1016 381/74 |
| 2014/0374859 | A1* | 12/2014 | Kasai | H04R 19/005 257/419 |
| 2015/0215689 | A1 | 7/2015 | Hartung et al. | |

OTHER PUBLICATIONS

Written Opinion issued in Intl. Appln. No. PCT/JP2016/074340 dated Sep. 20, 2016.
Extended European Search Report issued in European Appln. No. 16839225.6 dated Feb. 25, 2019.

* cited by examiner

SOUND OUTPUT AND PICKUP DEVICE

CROSS REFERENCE TO RELATED APPLICATIONS

The present application is a continuation application of International Patent Application No. PCT/JP2016/074340, filed on Aug. 22, 2016, which claims priority to Japanese Patent Application No. 2015-164817, filed on Aug. 24, 2015. The contents of these applications are incorporated herein by reference in their entirety.

BACKGROUND OF THE INVENTION

1. Field of the Invention

A preferred embodiment according to the present invention relates to a sound output and pickup device including a housing in which a speaker and a microphone are arranged.

2. Description of the Related Art

Conventionally, various kinds of audio conference devices have been devised as an example of a sound output and pickup device. For example, in an audio conference device disclosed in Japanese Patent No. 2739835, a microphone and a speaker are built in a housing.

In the audio conference device disclosed in Japanese Patent No. 2739835, the housing is substantially rectangular in a plan view. The speaker is arranged at the center of the housing. The microphone is arranged at each of the four corners of the housing. The microphone, except a sound pickup face and a wiring portion, is surrounded by an elastic member. The elastic member is provided in order to reduce the degree of an acoustic coupling between the microphone and the speaker.

However, in the audio conference device disclosed in Japanese Patent No. 2739835, the elastic member has an opening. Therefore, it is unavoidable that sound leaked from the speaker to the housing is picked up by the microphone through the opening.

In addition, it is conceivable that, mainly due to an error that occurs in a manufacturing process, the installation positions of the microphone and the elastic member in the housing are deviated from designed positions. In such a case, an unintended gap is formed and the sound leaked from the speaker to the housing is picked up by the microphone through the gap.

SUMMARY OF THE INVENTION

In view of the foregoing, an object of a preferred embodiment of the present invention is to provide a sound output and pickup device capable of significantly reducing or preventing sound leaked from a speaker to a housing from being picked up by a microphone while allowing an opening of an internal component, or a gap, the opening being unavoidable in manufacturing.

A sound output and pickup device according to a preferred embodiment of the present invention is provided with a speaker system, a microphone, and a housing. The housing is provided inside with the speaker system and the microphone, and has a wall that stores the speaker system and the microphone in separate space. The wall has a through hole. The distance from the through hole to the outside of the housing is shorter than the distance from the through hole to the microphone.

According to a preferred embodiment of the present invention, while an opening of an internal component or a gap is allowed, the opening and the gap being unavoidable in manufacturing, sound leaked from a speaker to a housing is more reliably reduced or prevented from being picked up by a microphone.

The above and other elements, features, characteristics, and advantages of the present invention will become more apparent from the following detailed description of the preferred embodiments with reference to the attached drawings.

BRIEF DESCRIPTION OF THE DRAWINGS

FIG. 4A is a plan view of the bottom cover, FIG. 4B is a first side view of the bottom cover, and FIG. 4C is a second side view of the bottom cover.

FIG. 5A is a plan view of the front face of the top cover, FIG. 5B is a plan view of the back face of the top cover, and FIG. 5C is a side sectional view of the top cover.

DETAILED DESCRIPTION OF THE PREFERRED EMBODIMENTS

Figure 1A:
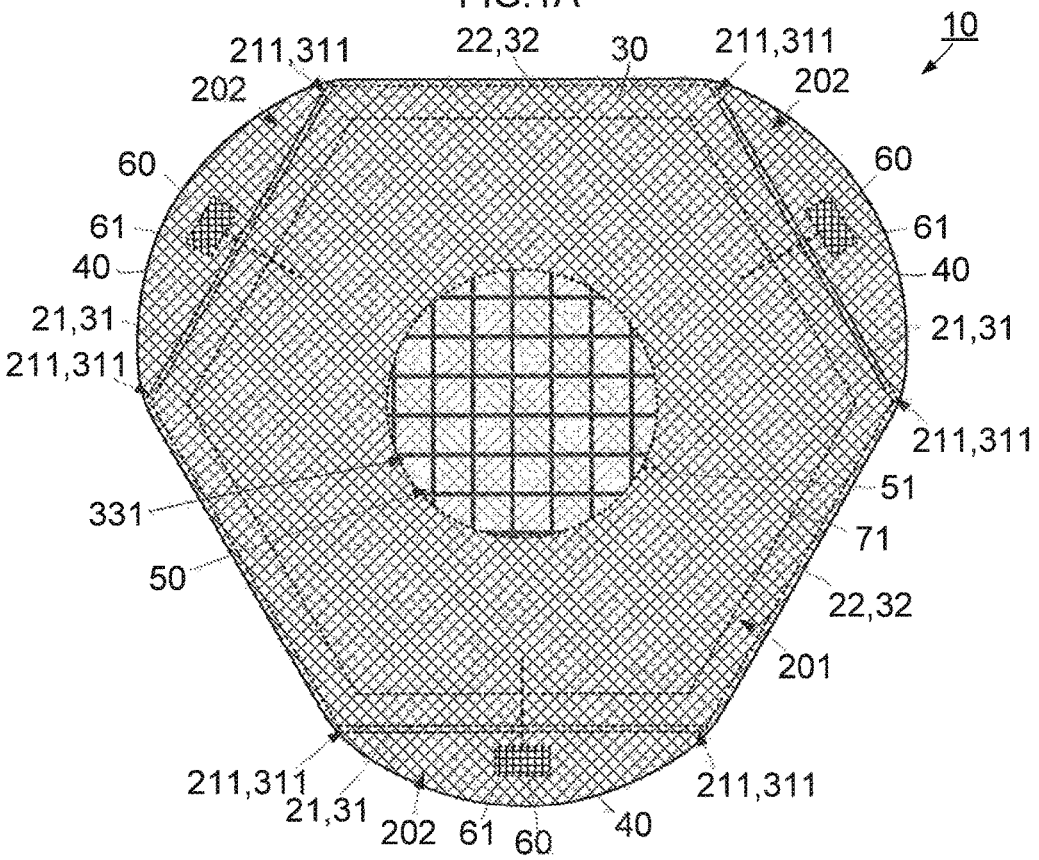
FIG. 1A is a plan view of a sound output and pickup device according to a preferred embodiment of the present invention.
Figure 1B:
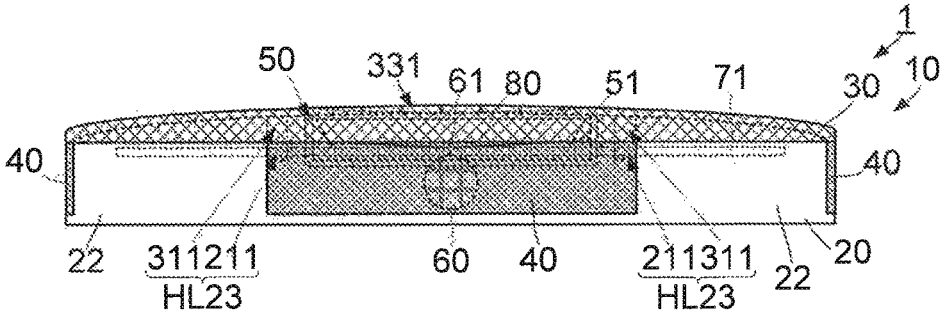
FIG. 1B is a side view of the sound output and pickup device according to the preferred embodiment of the present invention.
Figure 2A:
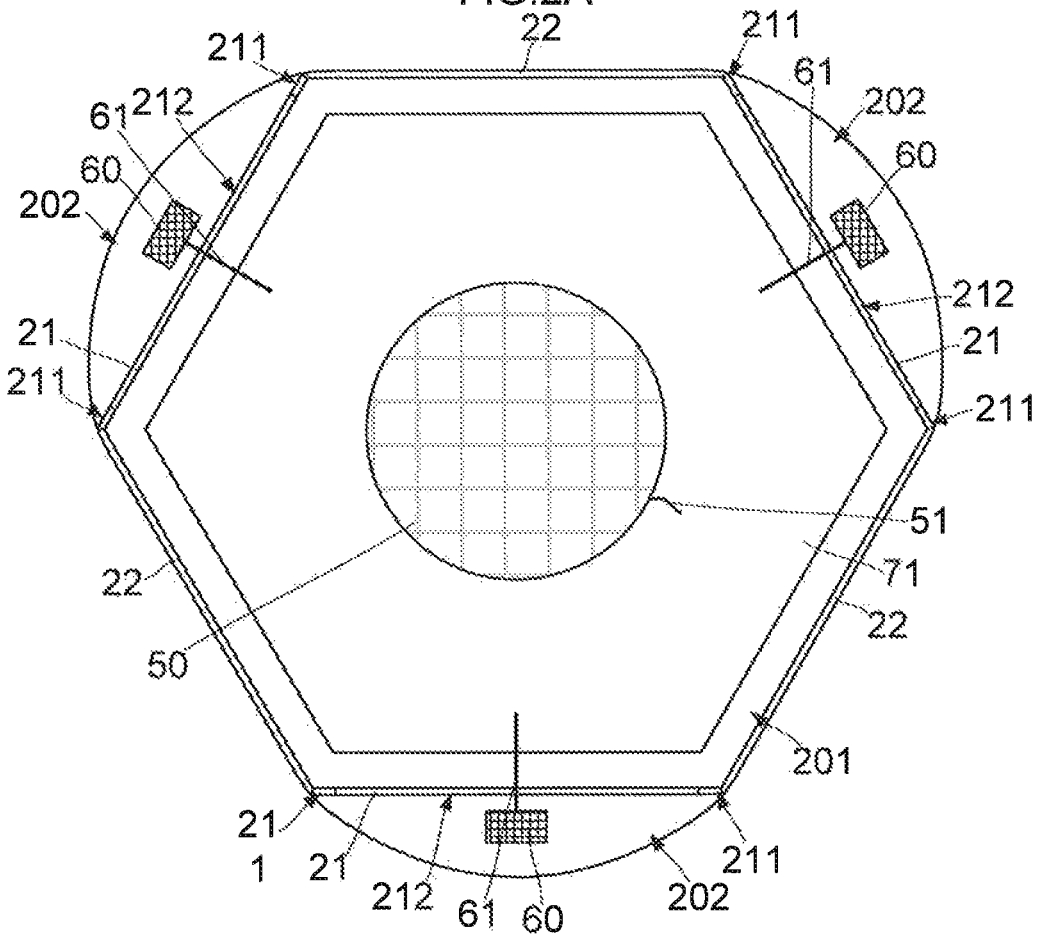
FIG. 2A is a plan view of a component arrangement of the sound output and pickup device according to the preferred embodiment of the present invention.
Figure 2B:
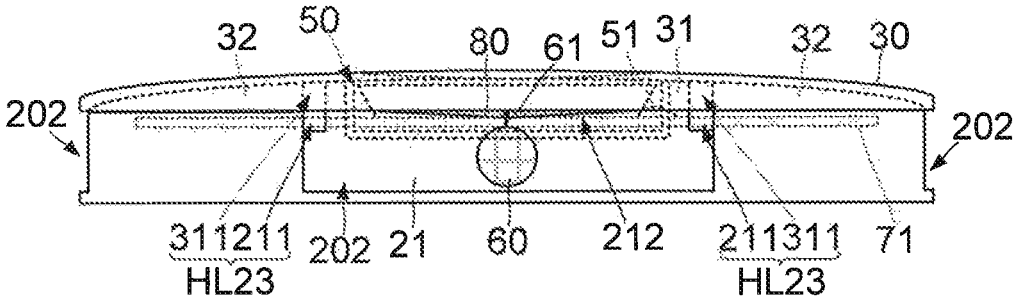
FIG. 2B is a side view of the component arrangement of the sound output and pickup device according to the preferred embodiment of the present invention.

A sound output and pickup device according to a preferred embodiment of the present invention will be described with reference to the drawings. FIG. 1A is a plan view of the sound output and pickup device according to the preferred embodiment of the present invention. FIG. 1B is a side view of the sound output and pickup device according to the preferred embodiment of the present invention. FIG. 2A is a plan view of a component arrangement of the sound output and pickup device according to the preferred embodiment of the present invention. FIG. 2B is a side view of the component arrangement of the sound output and pickup device according to the preferred embodiment of the present invention. FIG. 2A illustrates a state in which a top plate of the top cover of the sound output and pickup device is viewed in a see-through manner.

As illustrated in FIGS. 1A and 1B, the sound output and pickup device 1 is provided with a housing 10, a speaker system 50, and a plurality of microphones 60 (three in the preferred embodiment). The housing 10 is provided with a bottom cover 20, a top cover 30, and a shield plate 40. Although the details are not illustrated, the speaker system 50 includes a speaker unit, a baffle, and an enclosure or a horn. As illustrated in FIG. 1B, the bottom cover 20 and the top cover 30 are overlapped in a state in which the front face of the bottom cover 20 faces the back face of the top cover 30. In this manner, the housing 10 is formed. As illustrated in FIG. 1A, in a plan view, the housing 10 has a shape in which the three corners of a triangle are chamfered. The side faces at the three chamfered corners of the housing 10 are open.

As illustrated in FIGS. 1A and 1B and FIGS. 2A and 2B, a speaker housing space 201 and a microphone housing space 202 are separately formed in the housing 10.

The speaker housing space 201, in a plan view, is in a region of the center of the housing 10. The speaker housing space 201 is a sealed space that is surrounded by an outside wall configured by an outside wall 22 of the bottom cover 20 and an outside wall 32 of the top cover 30 that are vertically continuous, a partition configured by a partition 21 of the bottom cover 20 and a partition 31 of the top cover 30 that are vertically continuous, a bottom plate 200 of the bottom cover 20, and a top plate 300 of the top cover 30.

The speaker system 50 is arranged at a substantially center in a plan view of the housing 10. Accordingly, the speaker system 50 is housed in the speaker housing space 201. The speaker system 50 includes a sound output face and is arranged so that the sound output face may be on the side of the top face (on the side of the top cover 30) of the housing 10.

A plurality of sound output through holes 331 are formed in the center of the top plate 300 of the top cover 30 in a plan view. The sound output face of the speaker system 50 overlaps a region in which the plurality of sound output through holes 331 are formed. With such a configuration, the sound output face of the speaker system 50 is open to the side of the top face (top cover 30) of the housing 10.

In this manner, the speaker system 50 is arranged in the speaker housing space 201, while the sound output face is open to the outside with respect to the housing 10. At this time, while the housing 10 and the top cover 30 to form the speaker housing space 201 may preferably be closely contacted with each other over substantially the entire circumference, the present invention is not limited to such a configuration.

The microphone housing space 202 is arranged at each of the three corners of the housing 10 in a plan view. The microphone housing space 202 is a space that is surrounded by a partition configured by the partition 21 of the bottom cover 20 and the partition 31 of the top cover 30 that are vertically continuous, the bottom plate 200 of the bottom cover 20, and the top plate 300 of the top cover 30 and that is communicated with the outside by the opening at the corner of the housing 10.

The three microphones 60 are arranged at the three corners of the housing 10, respectively. Accordingly, the three microphones 60 are each individually housed in the microphone housing space 202. Each of the three microphones 60 is a unidirectional microphone, for example. The sound pickup face of each of the microphones 60 faces the opening of the side face (side opened to the outside of the microphone housing space 202) of the housing 10.

In this manner, the speaker system 50 and the three microphones 60 are each arranged in an independent and separate space in the housing 10. It is to be noted that the speaker system 50 is connected to a circuit board 71 arranged in the speaker housing space 201 by an audio cable 51. The audio cable 51 is fixed onto the top plate 300 of the top cover 30. The microphones 60 are each connected to the circuit board 71 by the audio cable 61. The microphones 60 are fixed onto the top plate 300 of the top cover 30.

The partition 21 includes a groove 211 that penetrates in the thickness direction of the partition 21. The groove 211 is formed at both ends in the width direction of the partition 21, that is, at end portions to be connected to the outside wall 22. The groove 211 is formed on a side of the partition 21, the side being brought into contact with the partition 31.

The partition 31 includes a groove 311 that penetrates in the thickness direction of the partition 31. The groove 311 is formed at both ends in the width direction of the partition 31, that is, at end portions to be connected to the outside wall 32. It is to be noted that, in the present preferred embodiment, the groove 311 has a shape obtained by entirely cutting out the partition 31 in the height direction.

Then, as described above, the bottom cover 20 and the top cover 30 are overlapped with each other, so that the groove 211 and the groove 311 are brought into communication with each other. This forms a through hole HL23 that has a shape penetrating a wall including the partition 21 and the partition 31 and includes the groove 211 and the groove 311. With such a configuration, the speaker housing space 201 communicates with each microphone housing space 202 only by the through hole HL23.

Figure 3:
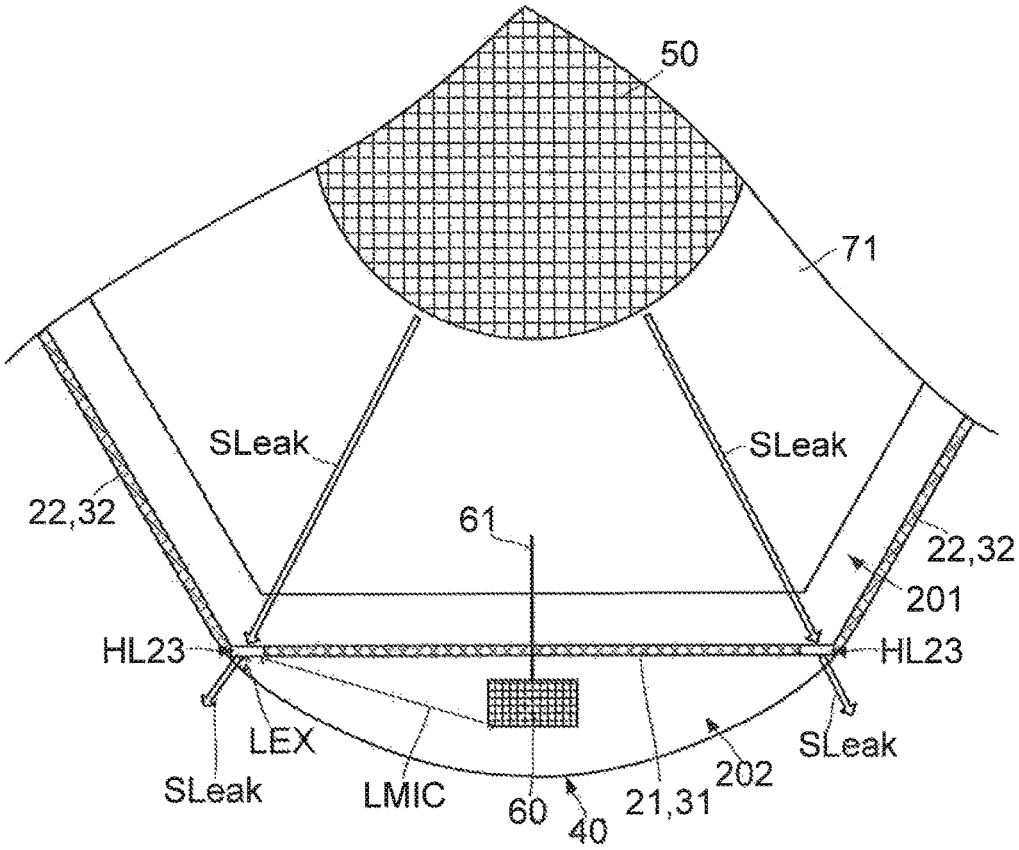
FIG. 3 is a view for illustrating the principle of the sound output and pickup device according to the preferred embodiment of the present invention.

FIG. 3 is a view for illustrating the principle of a sound output and pickup device according to a preferred embodiment of the present invention. FIG. 3 is a plan view showing an expanded one corner of the sound output and pickup device. FIG. 3 illustrates a state in which the top plate 300 of the top cover 30 is viewed in a see-through manner.

As illustrated in FIG. 3, the distance LEX between the through hole HL23 and the opening of the housing 10 is significantly shorter than the distance LMIC between the through hole HL23 and the microphone 60 (LEX<<LMIC). In other words, a length of the sound propagation route between the through hole HL23 and the opening of the housing 10 is significantly shorter than a length of the sound propagation route between the through hole HL23 and the microphone 60.

With such a configuration, sound propagated from the through hole HL23 to the microphone housing space 202 is hard to be propagated to the microphone 60 and easy to be radiated from the opening to the outside. Therefore, sound SLeak leaked from the speaker system 50 to the speaker housing space 201 in the housing 10 is radiated from the opening of the housing 10 to the outside through the through hole HL23.

Accordingly, the sound leaked from the speaker system 50 to the housing 10 is significantly reduced or prevented from being picked up by the microphone 60.

It is to be noted that the cross-sectional area of the through hole HL23 is large enough with respect to the area of a gap that may be generated when the bottom cover 20 and the top cover 30 are assembled. With such a configuration, even when a gap is generated when the bottom cover 20 and the top cover 30 are assembled, sound leaked from the speaker system 50 to the speaker housing space 201 propagates through the through hole HL23. Therefore, the sound SLeak leaked from the speaker system 50 to the speaker housing space 201 is radiated from the opening of the housing 10 to the outside through the through hole HL23.

In this manner, by using the configuration according to the present preferred embodiment, even in the sound output and pickup device 1 using the housing 10 including inside the speaker system 50 and the microphone 60, sound leaked from the speaker system 50 to the housing 10 is easy to be propagated to the outside through the through hole HL23. Therefore, the leakage sound is significantly reduced or prevented from being picked up by the microphone 60.

It is to be noted that in the sound output and pickup device 1 according to the present preferred embodiment, a shield plate 40 is installed at the opening of the side face of the housing 10. The shield plate 40 may be made of perforated metal, for example, and has a predetermined light shielding property while having air permeability. Accordingly, at the three corners of the housing 10, while sound is passed, the inside of the housing 10 is able to be significantly reduced or prevented from being seen from the opening of each of the corners. Accordingly, while significantly reducing or preventing the degradation of the sound pickup sensitivity of the microphone 60, the microphone 60 is able to be significantly reduced or prevented from being seen from the outside. In addition, the sound propagated to the side of the microphone housing space 202 through the through hole HL23 is able to be reliably outputted. Further, the through hole HL23 is able to be significantly reduced or prevented from being seen from the outside. Thus, the design quality of the sound output and pickup device 1 is able to be significantly reduced or prevented from being reduced due to provision of the through hole HL23.

The bottom cover 20 and the top cover 30 of such a sound output and pickup device 1 are specifically structured as follows.

Figure 4A:
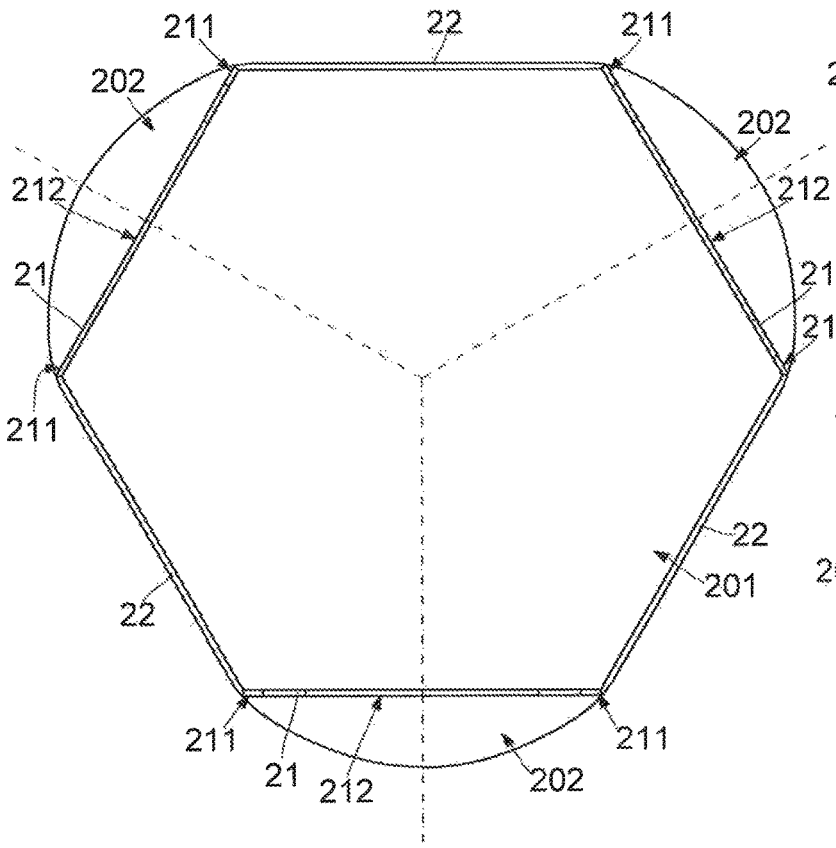
FIGS. 4A to 4C are three side views of a bottom cover according to a preferred embodiment of the present invention.
Figure 4C:
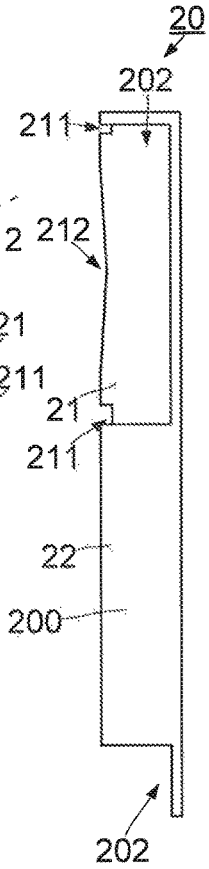
Figure 4B:
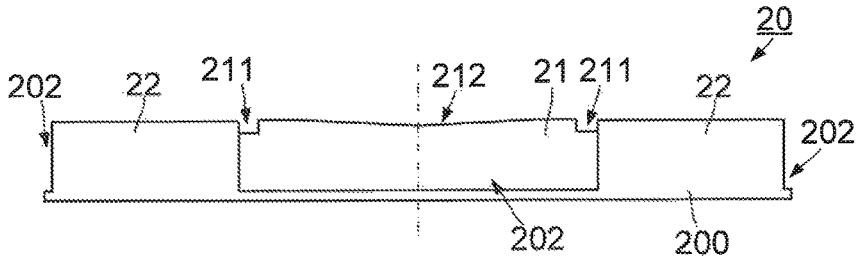

FIGS. 4A to 4C are three side views of a bottom cover according to a preferred embodiment of the present invention. FIG. 4A is a plan view of the bottom cover, FIG. 4B is a first side view of the bottom cover, and FIG. 4C is a second side view of the bottom cover.

The bottom cover 20 is provided with a bottom plate 200 that has a shape in which the three corners of a triangle are chamfered. The bottom plate 200 is provided with a partition 21 and an outside wall 22 in a standing manner. The outside wall 22 is provided along the outer side of the bottom plate 200, except the three corners, in a standing manner. The partition 21 is provided at the three corners of the bottom plate 200 in a standing manner. The partition 21 is provided closer to the center of the bottom plate 200 in a standing manner only by a predetermined distance from the three corners of the bottom plate 200. The partition 21 causes adjacent outside walls 22 to communicate with each other. With such a configuration, a space surrounded by the partition 21 and the outside wall 22 forms the lower half of the speaker housing space 201. In addition, a region closer to the corner of the bottom plate 200 than the partition 21 forms the lower half of the microphone housing space 202.

The groove 211 is formed at both ends in the width direction of the partition 21. The groove 211, as described above, forms the lower half of the through hole HL23.

In addition, the partition 21 includes a recess portion 212 at a substantially center in the width direction of the partition 21. The recess portion 212 is formed at a depth corresponding to the audio cable 61.

Figure 5A:
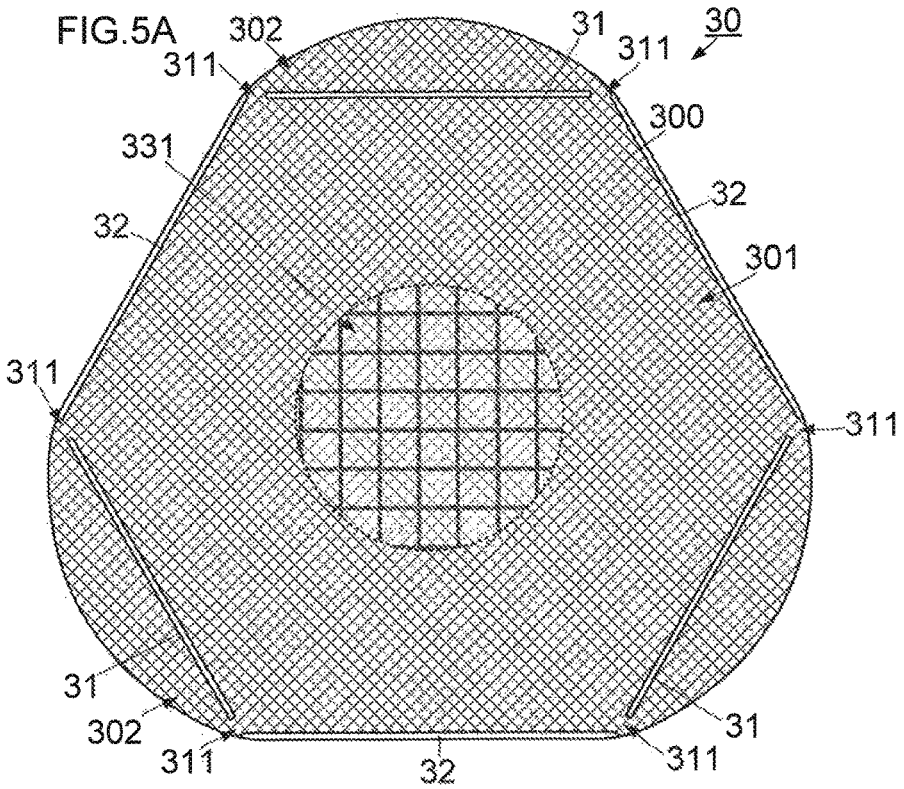
FIGS. 5A to 5C are three side views of a top cover according to a preferred embodiment of the present invention.
Figure 5B:
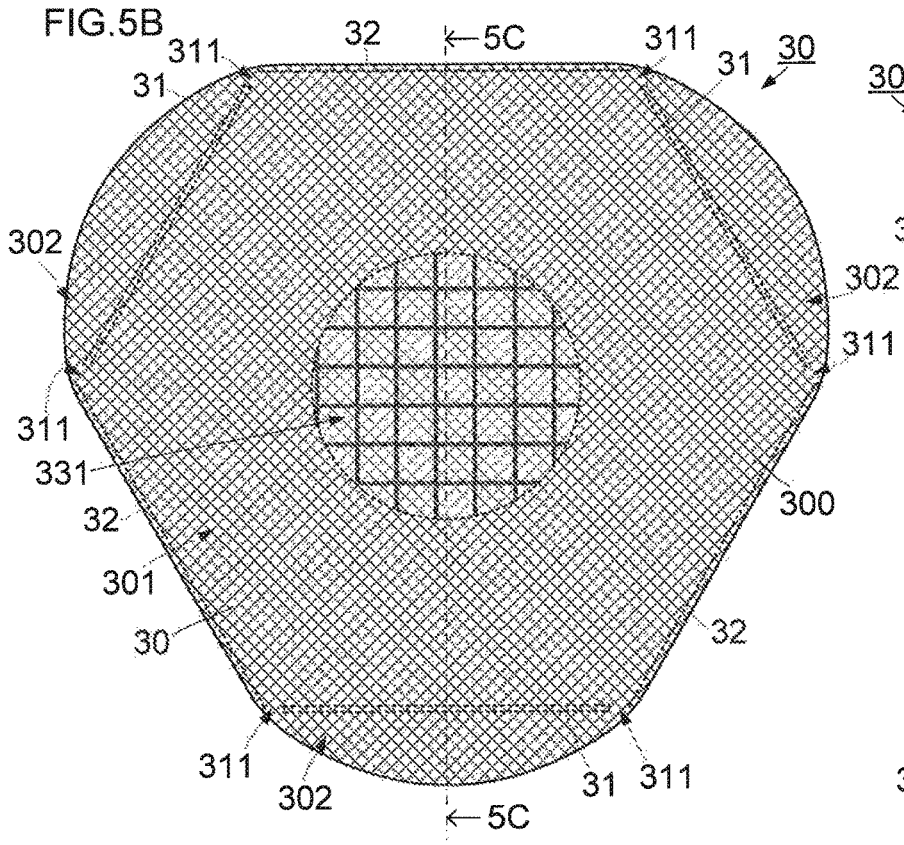
Figure 5C:
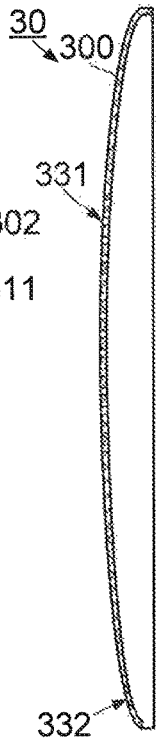

FIGS. 5A to 5C are three side views of a top cover according to a preferred embodiment of the present invention. FIG. 5A is a plan view of the front face of the top cover, FIG. 5B is a plan view of the back face of the top cover, and FIG. 5C is a side sectional view of the top cover.

The top cover 30 is provided with a top plate 300 that has a shape in which the three corners of a triangle are chamfered. The top plate 300 viewed in a plan view is substantially the same in shape as the bottom plate 200 of the bottom cover 20 viewed in a plan view.

The top plate 300 is provided with a partition 31 and an outside wall 32 in a standing manner. The outside wall 32 is provided along the outer side of the top plate 300, except the three corners, in a standing manner. The partition 31 is provided at the three corners of the top plate 300 in a standing manner. The partition 31 is provided closer to the center of the top plate 300 in a standing manner only by a predetermined distance from the three corners of the top plate 300. The partition 31 causes adjacent outside walls 32 to communicate with each other. With such a configuration, a space surrounded by the partition 31 and the outside wall 32 forms the upper half of the speaker housing space 201. In addition, a region closer to the corner of the top plate 300 than the partition 31 forms the upper half of the microphone housing space 202.

The groove 311 is formed at both ends of the width direction of the partition 31. The groove 311, as described above, forms the upper half of the through hole HL23.

The bottom cover 20 and the top cover 30 with such a configuration are assembled so that, in a plan view, the outside walls 22 and 32 may overlap and the partitions 21 and 31 may overlap. Accordingly, the housing 10 provided with the through hole HL23 is formed. In such a case, a cushion sheet 80 (of which the overall shape is not illustrated) is interposed between the outside walls 22 and 32 and between the partitions 21 and 31, except a part in which the grooves 211 and 311 are formed. The use of such a cushion sheet, even if the accuracy of assembling the bottom cover 20 and the top cover 30 is not high, is able to significantly reduce or prevent a gap from being generated when the bottom cover 20 and the top cover 30 are assembled.

In addition, with such a configuration, the audio cable 61 is inserted into a gap between the partitions 21 and 31, the gap being formed by the recess portion 212. As illustrated in FIG. 2B, the cushion sheet 80 is fitted into a gap between the audio cable 61 and the recess portion 212, so that a gap is significantly reduced or prevented from being generated. Accordingly, sound leaked into the speaker housing space 201 is able to be significantly reduced or prevented from being picked up by the microphone 60 through a portion other than the through hole HL23. The circuit board 71 and the microphone 60 are connected by the audio cable 61 through the recess portion 212, so that the audio cable 61 becomes shorter. This significantly reduces or prevents the audio cable 61 from acting as an antenna and receiving external noise.

It is to be noted that, while, in the above described configuration, a through hole is provided in the partition 21 and the partition 31 in the housing 10, a through hole may be provided at other positions in the housing 10. A through hole may be provided in the outside wall 22 and the outside wall 32. Further, a through hole may be provided in a portion that configures the speaker housing space 201 in the bottom plate 200 of the bottom cover 20. Alternatively, a through hole may be provided in a portion that configures the speaker housing space 201 in the top plate 300 of the top cover 30. However, when a through hole is provided in the partition 21 and the partition 31, the through hole is not exposed to the outside, and the design quality of the sound output and pickup device 1 is able to be significantly reduced or prevented from being reduced due to provision of the through hole.

In addition, in the above described configuration, the sealed speaker system, that is, the speaker configured by the speaker unit and the sealed enclosure, has been described. However, a speaker unit alone is able to be used in place of the speaker system. In this regard, a sealed enclosure or a sealed speaker system provided with other configurations is better to be used, so that sound leaked into the housing 10 is smaller and the above described configuration works more effectively.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A sound output and pickup device comprising:

a housing including a speaker housing space and a microphone housing space;

a speaker disposed in the speaker housing space; and a microphone disposed in the microphone housing space, wherein:

the housing includes a wall that divides the speaker housing space and the microphone housing space;

the wall includes a through hole;

the housing includes an opening;

a first distance between the through hole and the opening of the housing is shorter than a second distance from the through hole to the microphone;

the speaker includes a sound output face;

the wall is arranged in a direction that is different from a direction facing the sound output face; and the wall is not parallel with the sound output face.

2. The sound output and pickup device according to claim 1, wherein:

the microphone housing space and an outside of the housing communicate through the opening;

the wall includes a partition separating the speaker housing space from the microphone housing space; and the partition includes the through hole.

3. A sound output and pickup device comprising:

a housing including a speaker housing space and a microphone housing space;

a speaker disposed in the speaker housing space; and a microphone disposed in the microphone housing space, wherein:

the housing includes a wall that divides the speaker housing space and the microphone housing space;

the wall includes a through hole;

the housing includes an opening;

the microphone housing space and an outside of the housing communicate through the opening;

a first distance between the through hole and the opening of the housing is shorter than a second distance from the through hole to the microphone;

the speaker includes a sound output face;

the wall is arranged in a direction that is different from a direction facing the sound output face;

the wall is not parallel with the sound output face;

the wall includes a partition separating the speaker housing space from the microphone housing space;

the partition includes the through hole;

the through hole includes a first through hole and a second through hole;

the partition includes a first end and a second end in a width direction;

the first end includes the first through hole; and the second end includes the second through hole.

4. A sound output and pickup device comprising:

a housing;

a speaker disposed in the housing; and a microphone disposed in the housing, wherein:

the housing includes a wall that divides a speaker housing space where the speaker is disposed and a microphone housing space where the microphone is disposed;

the wall includes a through hole;

a distance from the through hole to an outside of the housing is shorter than a distance from the through hole to the microphone;

the housing includes a top cover and a bottom cover;

the top cover and the bottom cover are overlapped with each other in a vertical direction;

the top cover includes a first groove;

the bottom cover includes a second groove; and the first groove and the second groove are connected to form the through hole.

5. The sound output and pickup device according to claim 2, further comprising:

a shield plate with air permeability, wherein the shield plate is arranged at the opening.

6. The sound output and pickup device according to claim 4, wherein:

the top cover includes a first partition;

the bottom cover includes a second partition;

the first partition and the second partition are connected to form a partition that separates the speaker housing space and the microphone housing space; and a cross-sectional area of the through hole is larger than an area of a gap between the first partition and the second partition, the gap being formed by an arrangement of the microphone.

7. The sound output and pickup device according to claim 6, further comprising a cushion sheet embedded in the gap.

8. The sound output and pickup device according to claim 1, wherein the speaker is a sealed speaker system.

9. The sound output and pickup device according to claim 1, wherein the microphone is a unidirectional microphone.

10. The sound output and pickup device according to claim 1, further comprising:

a plurality of ones of the microphone, wherein the speaker is a single speaker.

11. The sound output and pickup device according to claim 4, wherein:

the sound output face faces the top cover; and the top cover and the bottom cover are connected over an entire circumference of the speaker housing space.

12. The sound output and pickup device according to claim 5, wherein the shield plate has light shielding property.

13. The sound output and pickup device according to claim 6, further comprising:

a circuit board arranged in the speaker housing space; and a sound cable that connects the circuit board and the microphone, wherein the sound cable passes through the gap.

14. The sound output and pickup device according to claim 3, wherein the top cover or the bottom cover includes a third through hole that connects the speaker housing space and the outside of the housing.

15. The sound output and pickup device according to claim 4, wherein:

the housing includes an opening;

the microphone housing space and the outside of the housing communicate through the opening;

the wall includes a partition separating the speaker housing space from the microphone housing space; and the partition includes the through hole.

16. The sound output and pickup device according to claim 1, wherein the first distance is from the through hole, along a direction of an axis of the through hole, to an outside of the housing.

17. The sound output and pickup device according to claim 3, wherein the first distance is from the through hole, along a direction of an axis of the through hole, to an outside of the housing.

18. The sound output and pickup device according to claim 3, further comprising:

a shield plate with air permeability, wherein the shield plate is arranged at the opening.

19. The sound output and pickup device according to claim 18, wherein the shield plate has light shielding property.

20. The sound output and pickup device according to claim 3, further comprising:

a plurality of ones of the microphone, wherein the speaker is a single speaker.

* * * * *